US005924752A

United States Patent [19]

Moody

[11] Patent Number: 5,924,752

[45] Date of Patent: Jul. 20, 1999

[54] ICE SPIKE

[76] Inventor: Jack R. Moody, W3917 County Trunk "C", Montello, Wis. 53949

[21] Appl. No.: 08/866,486

[22] Filed: May 30, 1997

[51] Int. Cl.[6] ..... B63C 9/32

[52] U.S. Cl. ..... 294/25; 441/82

[58] Field of Search ..... 294/1.1, 25, 26, 294/61; 2/16, 20, 21, 160, 161.1, 161.5, 161.6; 30/164.5, 298; 224/217, 218, 267; 441/80, 82

[56] References Cited

U.S. PATENT DOCUMENTS

| | | | |
|---|---|---|---|
| D. 299,285 | 1/1989 | Watson | D2/317 |
| 758,196 | 4/1904 | Thomas | 294/25 X |
| 816,681 | 4/1906 | Piller | 441/82 |
| 1,274,481 | 8/1918 | West | 294/25 X |
| 1,346,894 | 7/1920 | Jacobs | 294/25 |
| 1,583,754 | 5/1926 | Rogers | 294/25 |
| 2,278,610 | 4/1942 | Brownson et al. | 294/25 |
| 3,752,524 | 8/1973 | Reick, Jr. | 294/25 |
| 3,981,526 | 9/1976 | Lundqvist | 294/25 |
| 4,002,366 | 1/1977 | Hammes | 294/26 |
| 4,057,114 | 11/1977 | Anderson | 173/26 |
| 4,815,997 | 3/1989 | Forsmark et al. | 441/82 |
| 4,865,571 | 9/1989 | Caramanica et al. | 440/101 |
| 5,209,685 | 5/1993 | Hammes | 441/82 |
| 5,310,229 | 5/1994 | Hanson | 294/26 |

*Primary Examiner*—Johnny D. Cherry
*Attorney, Agent, or Firm*—Brian G. Gilpin; Godfrey & Kahn, S.C.

[57] ABSTRACT

A safety device comprising an ice spike having a mounting piece strapped to the forearm of the wearer with a spike support plate attached to the mounting piece by a hinge. An opener is biased to position the spike support plate in an open position and the spike support plate is held in a closed position using a hook and loop fastener. When the spike support plate is in the open position, a spike attached to the spike support plate is positioned by a spring or the equivalent such that its pointed end points outwardly from the spike support plate. The ice spike provides a person who has fallen through a hole in the ice with a device capable of gripping the slippery edges of the hole such that the person can extricate himself from the hole.

17 Claims, 2 Drawing Sheets

ICE SPIKE

FIELD OF THE INVENTION

This invention relates generally to a safety device and more particularly to an ice gripping device having retractable prongs that can be worn on the body.

BACKGROUND OF THE INVENTION

A major concern of ice fisherman, snowmobilers, hikers, ice skaters, and others who engage in winter activities on frozen ponds, streams, lakes or rivers is breaking through thin ice and plunging into the near-freezing water below. The result of falling through the ice is often death of the individual due to drowning or hypothermia. It is often impossible for an unaided individual to escape from the water because of slippery ice surrounding the hole, swift currents in the water beneath the ice, the cold temperature of the water, or because the person is weighed down by water-soaked clothing. It is therefore desirable to provide people engaging in outdoor activities on ice with a device to assist them in extracting themselves from a hole in the ice.

Several attempts at such a device are known, each having limitations and disadvantages. The Life Saving Apparatus disclosed in U.S. Pat. No. 816,681 has a wristband with several spikes provided for gripping the ice. There are several limitations inherent in such a device—for example, the device is uncomfortable for the wearer, and the device is not very effective in gripping the ice.

The Ice Mitten disclosed in U.S. Pat. No. 1,274,481 has a spiked, hinged plate strapped to the wearer's wrist. The device is intended for use in handling pieces of ice and cannot be effectively used by the wearer to pull himself out of a hole in the ice. Indeed, the spikes provided are not intended to bear the entire weight of the wearer. Finally, the spikes are constantly exposed making it a significant hindrance as well as hazardous and uncomfortable if the device is worn at all times while the user is on the ice.

The Gripping Device disclosed in U.S. Pat. No. 3,752,524 has a plurality of retractable spikes that are housed in a housing worn on the wrist. While the spikes of the Gripping Device may be sufficient to grip the ice surrounding a hole, the spikes are not located in an effective location. Often, a panicked or cold user lacks the dexterity to disengage the complicated mechanism for uncovering the spikes and can drown or freeze while attempting to deploy the spikes.

The Spike Tool disclosed in U.S. Pat. No. 3,981,526 consists of a partial glove having spikes protruding therefrom. While the Spike Tool provides a relatively stronger spike than the previously described devices, it must be worn on the hand. This configuration can interfere with the ability of the wearer to handle objects or perform detailed work and is generally uncomfortable to the wearer.

Thus, it is desirable to provide an apparatus for use by a person who has fallen through a hole in the ice that can be comfortably worn, has sufficient strength and penetration ability to assist the wearer in extracting himself from the hole, and is easily deployed.

OBJECTS OF THE INVENTION

It is, therefore, an object of the present invention to provide an ice spike that can be safely and comfortably worn on the body of a person engaging in activities on frozen ponds, lakes, streams, or rivers for extended periods of time.

It is an additional object of the present invention to provide an inexpensive and uncomplicated ice spike design.

It is a further object of the present invention to provide an ice spike that has the ability to assist a person who has fallen through a hole in the ice in extracting himself.

It is yet another object of the present invention to provide an ice spike having retractable spikes that are easily deployed by the wearer in an emergency or panic situation.

It is still another object of the present invention to provide an ice spike that does not hinder the wearer's activities on the ice or affect the wearer's ability to use his hands while wearing the device.

These and other objects and advantages of the present invention will become apparent from the description and accompanying drawings.

SUMMARY OF THE INVENTION

The ice spike of the present invention overcomes the disadvantages and limitations of existing devices by providing an ice spike that can be comfortably worn without hindrance of motion, can assist the wearer in extracting himself from a hole in the ice, and is easily deployed. The ice spike of the present invention is generally worn on the wearer's wrist with the spikes enclosed in a housing when not in use. When needed, the spikes are released by opening a fastener to swing the spike arm of the housing into the palm of the wearer's hand.

The ice spike comprises a housing having two arms, a hinge between the two arms, an opening device biased to hold the housing open, and spikes. The spikes are mounted to one of the arms using a spring that is biased to cause the spikes to move into ice engaging position for engaging ice upon the opening of the housing. The two arms of the housing are held closed, against the bias of the opening device, using a hook and loop fastener or the equivalent. The housing is strapped to the forearm or wrist area of the user using adjustable straps. The straps are of sufficient length so that the ice spike can be worn over heavy winter clothing.

BRIEF DESCRIPTION OF THE DRAWINGS

The features of the subject invention are better understood in conjunction with the Detailed Description and the Drawings of which.

DETAILED DESCRIPTION

Figure 1:
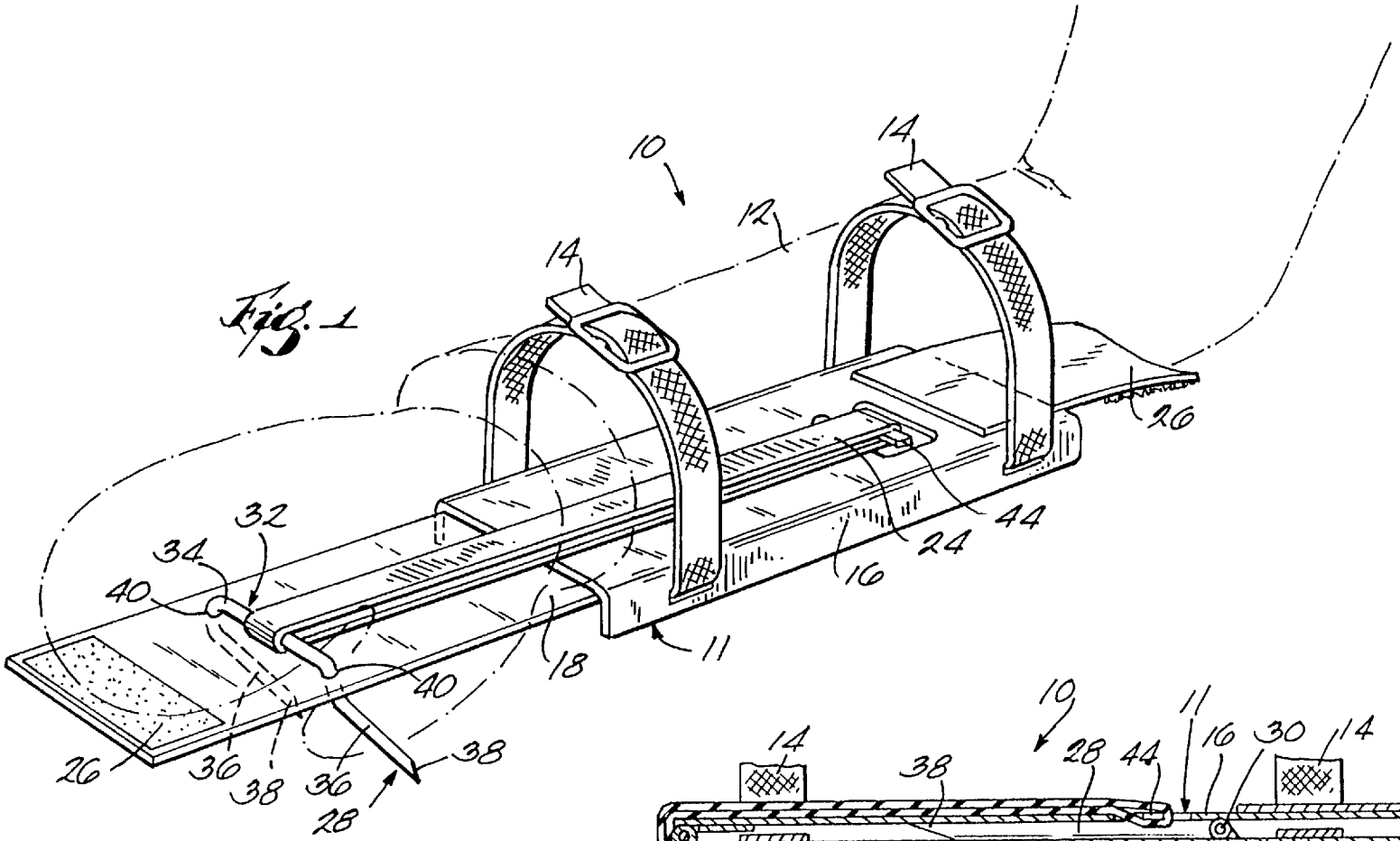
FIG. 1 is a perspective view of an ice spike in accordance with the present invention with the arm of the person wearing the ice spike shown in phantom.

The ice spike 10 shown in FIG. 1 has a frame 11 which can be attached to a person's forearm 12 by adjustable straps 14. The straps 14 are sufficiently long that the ice spike 10 can be worn over a thick winter coat and gloves. Preferably, two straps 14 are used but one strong strap 14 or other securing means can be employed to position the frame 11 on the wearer's forearm 12. The frame 11 comprises a mounting piece 16 which is connected to a spike support plate 18 via a hinge 20.

Figure 3:
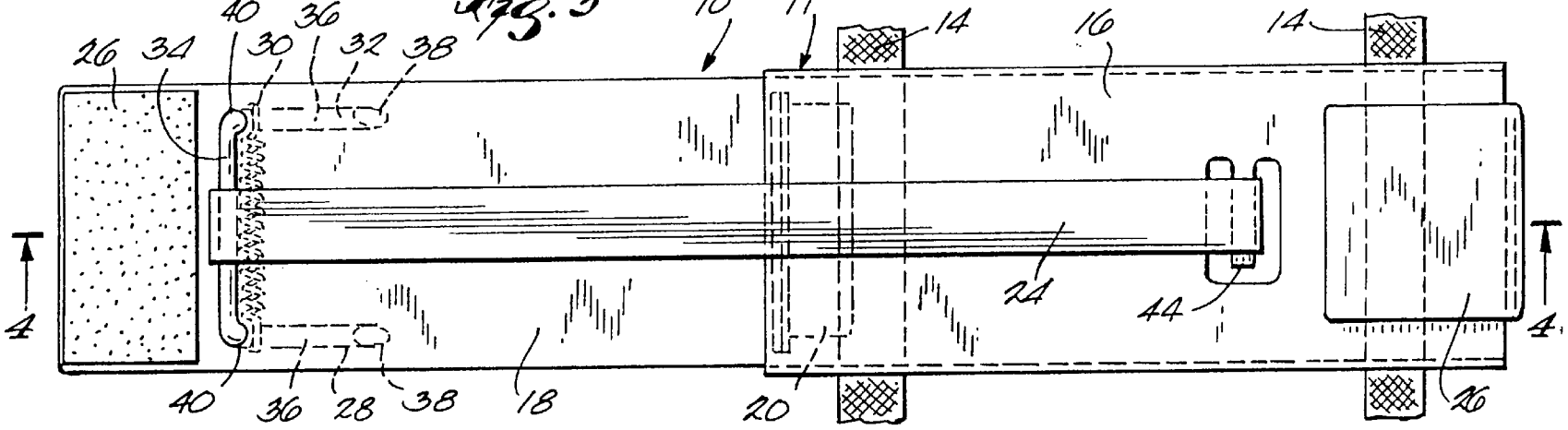
FIG. 3 is a top plan view of an ice spike in accordance with the present invention in the open position.
Figure 4:
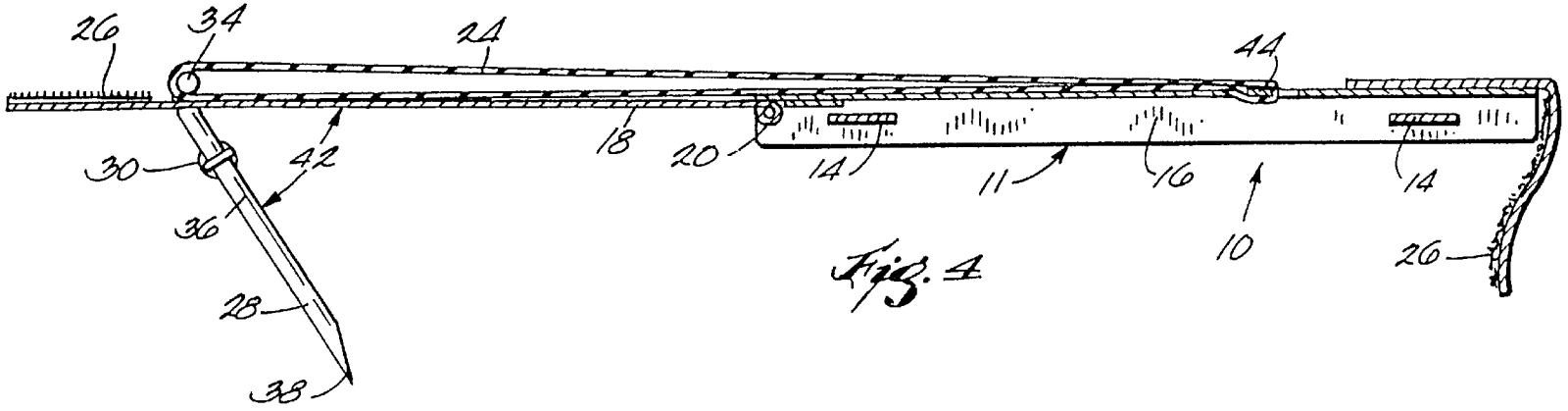
FIG. 4 is a cross-section of the ice spike shown in FIG. 3 taken generally along the line 4—4.

The frame 11 of the ice spike 10 is shown in an open position in FIGS. 1, 3, and 4. In this position, the mounting piece 16 is preferably securely strapped to the wearer's forearm 12 and the spike support plate 18 is biased to the open position by band 24. The spike support plate 18, when in the open position, is substantially an extension of mounting piece 16 and is intended to fall into the palm area of the wearer's hand.

Figure 2:
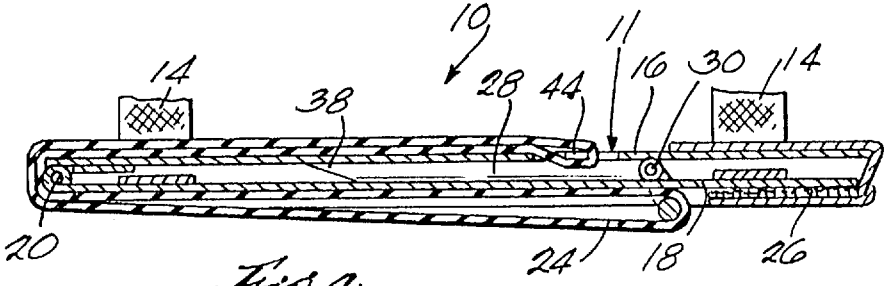
FIG. 2 is a cross-section of the ice spike shown in FIG. 3 in the closed position taken generally along the line 4—4.

FIG. 2 is a cross-section of the frame 11 of the ice spike 10 in a closed position. In the closed position, the spike support plate 18 has been rotated about hinge 20 and is positioned closely and substantially parallel to the mounting piece 16 against the bias of the band 24. The spike support plate 18 is held in the closed position against the bias of the opener by a hook and loop fastener 26 or the like.

As best shown in FIGS. 1 and 3, the ice spike 10 has a pair of spikes 36 joined together with a straight segment 34 to form a u-shaped piece 32. The u-shaped piece 32 is preferably pivotably secured to the spike support plate 18 with the band 24 such that the spikes 36 extend downwardly through two apertures 40 in the spike support plate 18. A torsion spring 30 runs between and is connected to the spikes 36 on the underside of the spike support plate 18. This spring 30 biases the spikes 36 away from the support plate 18.

While the torsion spring 30 comprises a coil and lever arms providing a biasing force to the spikes 36 of the u-shaped piece 32, the spring 30 could be configured as an axially wound spring on the straight segment 34 of the u-shaped piece 32. In either case, the spring 30 is biased such that when the frame 11 is in the open position, the pointed ends 38 of the spike 28 point outwardly from the spike support plate 18 at an angle 42 (FIG. 4) that allows the wearer of the ice spike 10 to grip the ice. While a wide range of angles 42 may be used, an angle 42 of approximately forty-five degrees (45°) from the plane of the spike support plate 18 is preferred to achieve the ice gripping purpose.

The band 24 is preferably made from an elastic material and is used to bias the spike support plate 18 toward the open, extended position. An anchor tab 44 in the mounting piece 16 is used to attach the band 24 to the frame 11 while at the other end the band 24 is wrapped around the straight segment 34 of the u-shaped piece 32. When the ice spike 10 is in the closed position, the band 24 is stretched beyond its relaxed position. This acts to bias the spike support plate 18 away from the mounting piece 16 such that it rotates about the axis of the hinge 20 when not held in place by the hook and loop fastener 26.

The mounting piece 16 and the spike support plate 18 may be made from steel or other metal or any other material of relatively high strength and rigidity. The hinge 20 joining the spike support plate 18 to the mounting piece 16 may made from steel or other material.

While in the preferred embodiment a band 24 is stretched between the anchor tab 44 in the mounting piece 16 and the straight segment 34 of the u-shaped piece 32, a spring or other biasing means could be employed to bias the spike support plate 18 toward the open position.

The u-shaped piece 32 forming the spike 30 may be made from steel or other relatively strong rigid material. The straps 14 may be made from any number of appropriately strong and flexible materials. Additionally, while in the preferred embodiment a hook and loop fastener 26 is used to hold the spike support plate 18 in the closed position against the bias of the band, other devices such as snaps or adhesive strips may be employed.

In use, a wearer fastens the mounting piece 16 of the ice spike 10 to his forearm 12 before engaging in activity on ice. The ice spike 10 is oriented such that the hinged end is located at or near the wearer's wrist, with the fastener end toward the wearer's elbow. The device is strapped on or fastened to the wearer's arm such that the spike support plate 18 swings outwardly away from the wearer's arm about hinge 20. When mounted on the wearer's arm, the spike support plate 18 should be in the closed position, that is, fastened against the mounting piece 16 against the bias of the elastic band 24 and held in the closed position by the hook and loop fastener 26. If the wearer should fall through a hole in the ice, he simply opens the hook and loop fastener 26 releasing the spike support plate 18 which automatically swings into the open position. As the spike support plate 18 swings into the open position, the spikes 36 spring into their use position to form an angle 42 with the spike support plate 18. When the ice spike 10 is in the open position, the spike 28 provides the wearer with the ability to grip the wet, slippery edges of a hole in the ice. This extra gripping ability assists the wearer in extricating himself from near-freezing water.

As illustrated by the foregoing description, the present invention is more suitable as an easy to use, inexpensive ice life saving device than are any prior such devices. The present invention overcomes the limitations and disadvantages of existing devices by utilizing a design that is comfortable to wear, has spikes that are effective in helping the wearer extricate himself from a hole in the ice, has spikes that are easily deployed, and may be worn over clothing.

Although the invention has been herein shown and described in what is conceived to be the most practical and preferred embodiment, it is recognized that modifications may be made by one of skill in the art of the invention without departing from the spirit or intent of the invention.

I claim:

1. A safety device comprising:

a first support plate;

a second support plate connected to said first support plate at a hinge, wherein said second support plate is movable rotationally about said hinge relative to said first support plate between a closed position and an open position;

first biasing means biasing said second support plate toward said open position, wherein said second support plate is substantially co-planar relative to said first support plate when in said open position;

at least one spike connected to said second support plate, wherein said spike is collapsible relative to said second support plate to achieve a collapsed position substantially parallel to said second support plate;

second biasing means biasing said spike toward a use position, wherein said spike is positioned angularly away from said second support plate when in said use position;

closure means for maintaining said first and second support plates in said closed position in opposition to the bias imparted by said first biasing means; and fastening means for securing said safety device to a limb of a wearer.

2. The safety device of claim 1, wherein said spike comprises a u-shaped piece having a straight segment joining two shafts ending in pointed ends, said u-shaped piece pivotably secured relative to said second support plate.

3. The safety device of claim 2, wherein said first biasing means comprises an elastic band.

4. The safety device of claim 3, wherein said closure means is a hook and loop fastener.

5. The safety device of claim 4, wherein said fastening means comprises at least one strap.

6. The safety device of claim 2, wherein said second biasing means comprises a spring biased to position said spike in said use position.

7. The safety device of claim 6, wherein said closure means is a hook and loop fastener.

8. A safety device comprising:

a body having a mounting piece and a spike support plate, said mounting piece adapted to be secured to a limb of a wearer;

means for pivotably coupling said spike support plate to said mounting piece;

means for opening said body to an open position, said body opening means biased to position said spike support plate in said open position relative to said mounting piece;

means for securing a spike to said spike support plate; and a means for biasing said spike to a use position where said spike is disposed outwardly from said spike support plate.

9. The safety device of claim 8, wherein said spike comprises a u-shaped piece having a straight segment joining two shafts ending in pointed ends, said u-shaped piece pivotably secured to said spike support plate.

10. The safety device of claim 9, wherein said body opening means comprises an elastic band.

11. The safety device of claim 10, further comprising means for releasably securing said spike support plate in a closed position relative to said mounting piece against the bias of said body opening means.

12. The safety device of claim 11, wherein said securing means comprises a hook and loop fastener.

13. The safety device of claim 11, wherein said mounting piece is secured to the limb of a wearer by at least one strap.

14. The safety device of claim 10, wherein said spike biasing means comprises a spring biased to position said spike such that said spike is positioned outwardly from said spike support plate.

15. The safety device of claim 9, wherein said means for pivotably coupling said spike support plate to said mounting piece comprises a hinge.

16. The safety device of claim 9, wherein said body opening means comprises a spring biased to position said spike support plate in said first open position relative to said mounting piece.

17. A safety device comprising:

a first support plate;

a second support plate connected to said first support plate at a hinge, wherein said second support plate is movable rotationally about said hinge relative to said first support plate between a closed position and an open position;

an elastic band biasing said second support plate toward said open position, wherein said second support plate is substantially co-planar relative to said first support plate when in said open position;

at least one spike pivotably secured to said second support plate, said spike being formed from a u-shaped piece having a straight segment joining two shafts ending in pointed ends, wherein said spike is collapsible relative to said second support plate to achieve a collapsed position substantially parallel to said second support plate;

a spring biasing said spike toward a use position, wherein said spike is positioned angularly away from said second support plate when in said use position;

a fastener for maintaining said first and second support plates in said closed position in opposition to the bias imparted by said elastic band; and at least one strap for securing said safety device to a limb of a wearer.

* * * * *